US011627862B2

(12) United States Patent
Ross et al.

(10) Patent No.: US 11,627,862 B2
(45) Date of Patent: Apr. 18, 2023

(54) DISHWASHING APPLIANCES AND METHODS FOR EVALUATING PRESSURE THEREIN

(71) Applicant: Haier US Appliance Solutions, Inc., Wilmington, DE (US)

(72) Inventors: Christopher Brandon Ross, Louisville, KY (US); Kyle Edward Durham, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 289 days.

(21) Appl. No.: 17/064,842

(22) Filed: Oct. 7, 2020

(65) Prior Publication Data

US 2022/0104684 A1 Apr. 7, 2022

(51) Int. Cl.
*A47L 15/46* (2006.01)
*A47L 15/08* (2006.01)

(52) U.S. Cl.
CPC ..... *A47L 15/46* (2013.01); *A47L 15/08* (2013.01); *A47L 2401/14* (2013.01); *A47L 2401/26* (2013.01); *A47L 2501/05* (2013.01); *A47L 2501/28* (2013.01); *A47L 2501/30* (2013.01)

(58) Field of Classification Search
CPC ..... A47L 15/46; A47L 15/08; A47L 15/4244; A47L 15/4259; A47L 15/0449; A47L 2401/14; A47L 2401/26; A47L 2501/05; A47L 2501/28; A47L 2501/30
See application file for complete search history.

(56) References Cited

U.S. PATENT DOCUMENTS

| | | | | |
|---|---|---|---|---|
| 10,178,936 | B2 | 1/2019 | Defilippi | |
| 10,624,521 | B2 | 4/2020 | Durham | |
| 2019/0159652 | A1* | 5/2019 | Durham | A47L 15/23 |

FOREIGN PATENT DOCUMENTS

| | | | |
|---|---|---|---|
| EP | 0546923 | A1 | 6/1993 |
| JP | 2910168 | B2 * | 6/1999 |
| JP | 2000296094 | A | 10/2000 |
| KR | 960007858 | B1 * | 6/1996 |
| KR | 20070007554 | A * | 1/2007 |
| KR | 101208305 | B1 | 12/2012 |

OTHER PUBLICATIONS

Machine translation: KR2007007554; Cho et al. (Year: 2007).*
Machine translation: KR960007858; Ahn, Y. (Year: 1996).*
Machine translation: JP2910168; Taketo et al. (Year: 1999).*

* cited by examiner

*Primary Examiner* — Natasha N Campbell
(74) *Attorney, Agent, or Firm* — Dority & Manning, P.A.

(57) ABSTRACT

A dishwashing appliance may include a cabinet, a tub, a spray assembly, a circulation pump, a pressure sensor, and a controller. The circulation pump may be in fluid communication with a wash chamber defined by the tub. The pressure sensor may be upstream of the circulation pump. The controller may be configured to initiate a washing operation including activating the circulation pump, detecting movement of the door from a closed position, detecting return of the door to the closed position, calculating a modified time period for flood detection, determining pressure at the pressure sensor exceeds a pressure threshold following detecting return of the door to the closed position, initiating the modified time period in response to determining pressure at the pressure sensor exceeds the pressure threshold, and directing the circulation pump based on measuring the elevated pressure and expiration of the modified time period.

20 Claims, 6 Drawing Sheets

DISHWASHING APPLIANCES AND METHODS FOR EVALUATING PRESSURE THEREIN

FIELD OF THE INVENTION

The present subject matter relates generally to dishwashing appliances, and more particularly to features and methods for addressing variations in pressure and potential impacts to an operation of a dishwashing appliance.

BACKGROUND OF THE INVENTION

Dishwashing appliances generally include a tub that defines a wash chamber. Rack assemblies can be mounted within the wash chamber of the tub for receipt of articles for washing. Multiple spray assemblies can be positioned within the wash chamber for applying or directing wash fluid (e.g., water, detergent, etc.) towards articles disposed within the rack assemblies in order to clean such articles. Dishwashing appliances are also typically equipped with one or more pumps, such as a circulation pump or a drain pump, for directing or motivating wash fluid from the wash chamber (e.g., to the spray assemblies or an area outside of the dishwashing appliance).

Conventional dishwashing appliances often include one or more pressure sensors to detect water pressure within the dishwashing appliance (e.g., during a wash cycle). In particular, such pressure sensors may be provided to detected elevated pressure states, which may indicate a clog or some other issue within the wash chamber is causing the dishwashing appliance to be at risk of flooding. As a way of addressing such concerns, typical dishwashing appliances are configured to stop a washing operation or wash cycle as soon as an excessive pressure is detected. Separate from or in addition to concerns related to a unit flooding, issues may arise when opening the door to the dishwashing appliance during a heated wash cycle. In particular, if the cool air from the ambient environment enters a relatively hot wash chamber while the door is open and the circulation pump is activated after the door is shut, the cool air will rapidly increase in temperature. As the air temperature increase, the air will expand. If there is an insufficient air path for air to escape the wash chamber, this expanded air will cause an increase to the total pressure inside the unit. This can result in various negative effects on the unit including the door popping open, water expulsion from air paths, inconsistent pressure readings, etc. Although dedicated air gaps may be provided (e.g., in vents, gasket gaps, etc.) to mitigate such concerns, they may also allow desirable heat to escape or otherwise lead to inefficiencies in the dishwashing appliance.

As a result, it would be advantageous to provide a dishwashing appliance or method of operation addressing one or more of the above concerns. In particular, it would be useful for a dishwashing appliance or method to permit the opening of the door during a heated wash cycle without inadvertently halting the appliance or risking excessive air expansion.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a dishwashing appliance is provided. The method may include activating a circulation pump. The method may also include detecting movement of a door from a closed position and detecting return of the door to the closed position. The method may further include calculating a modified time period for flood detection. The method may still further include determining pressure at a pressure sensor exceeds a pressure threshold following detecting return of the door to the closed position, and initiating the modified time period in response to determining pressure at the pressure sensor exceeds the pressure threshold. The method may yet further include directing the circulation pump based on measuring the elevated pressure and expiration of the modified time period.

In another exemplary aspect of the present disclosure, a dishwashing appliance is provided. The dishwashing appliance may include a cabinet, a tub, a door, a spray assembly, a circulation pump, a pressure sensor, and a controller. The tub may be positioned within the cabinet and define a wash chamber for receipt of articles for washing. The door may be mounted to the cabinet to selectively restrict access to the tub. The spray assembly may be positioned within the wash chamber. The circulation pump may be in fluid communication with the wash chamber. The pressure sensor may be upstream of the circulation pump. The controller may be in operative communication with the pressure sensor and the circulation pump. The controller may be configured to initiate a washing operation. The washing operation may include activating the circulation pump, detecting movement of the door from a closed position, detecting return of the door to the closed position, calculating a modified time period for flood detection, determining pressure at the pressure sensor exceeds a pressure threshold following detecting return of the door to the closed position, initiating the modified time period in response to determining pressure at the pressure sensor exceeds the pressure threshold, and directing the circulation pump based on measuring the elevated pressure and expiration of the modified time period.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
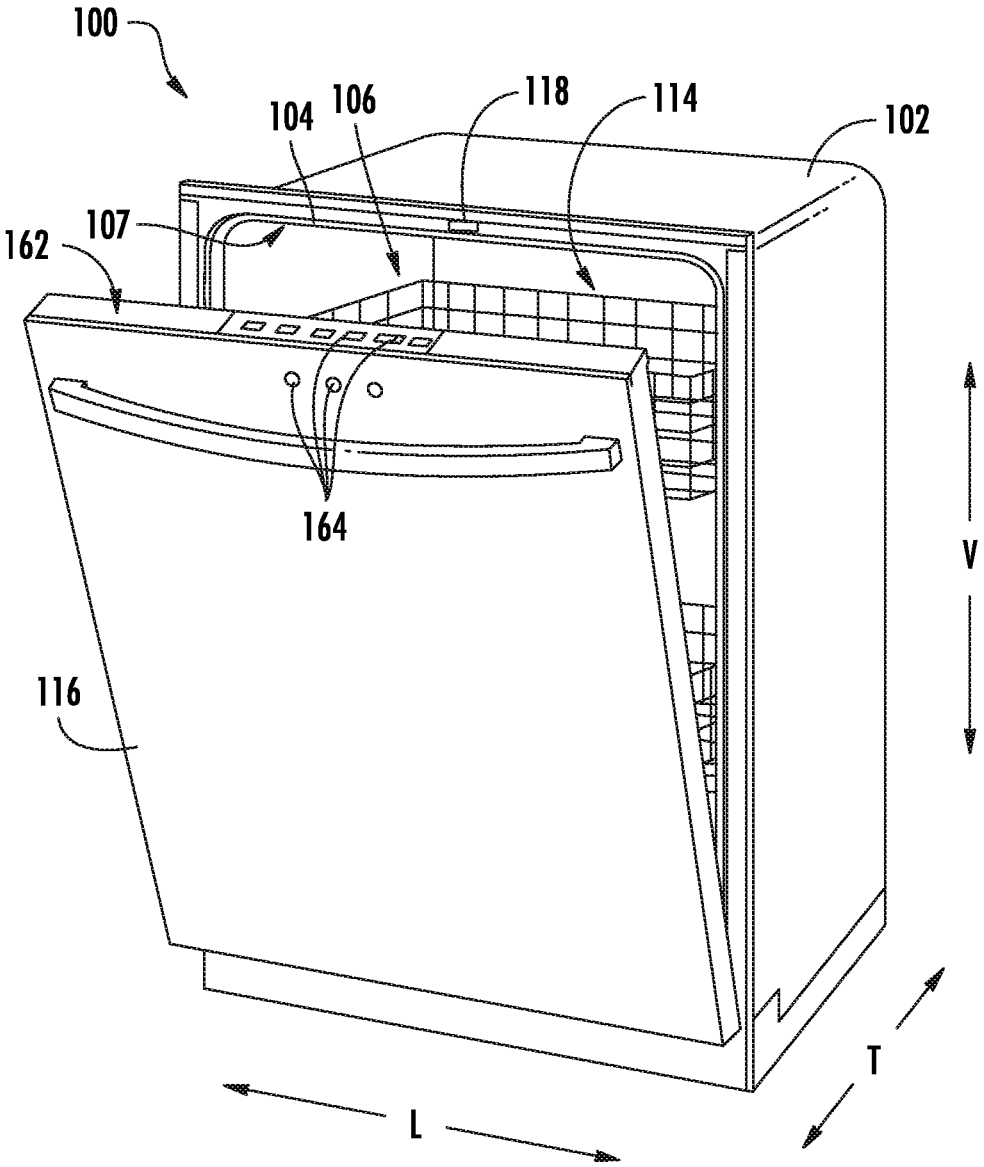
FIG. 1 provides a perspective view of an exemplary embodiment of a dishwashing appliance of the present disclosure with a door in a partially open position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For instance, "upstream" refers to the flow direction from which the fluid flows, and "downstream" refers to the flow direction to which the fluid flows. The term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a wash fluid (e.g., water, detergent, or wash additive). The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing or rinsing the articles that is typically made up of water and may include additives, such as detergent or other treatments (e.g., rinse aid). Furthermore, as used herein, terms of approximation, such as "approximately," "substantially," or "about," refer to being within a ten percent (10%) margin of error.

Figure 2:
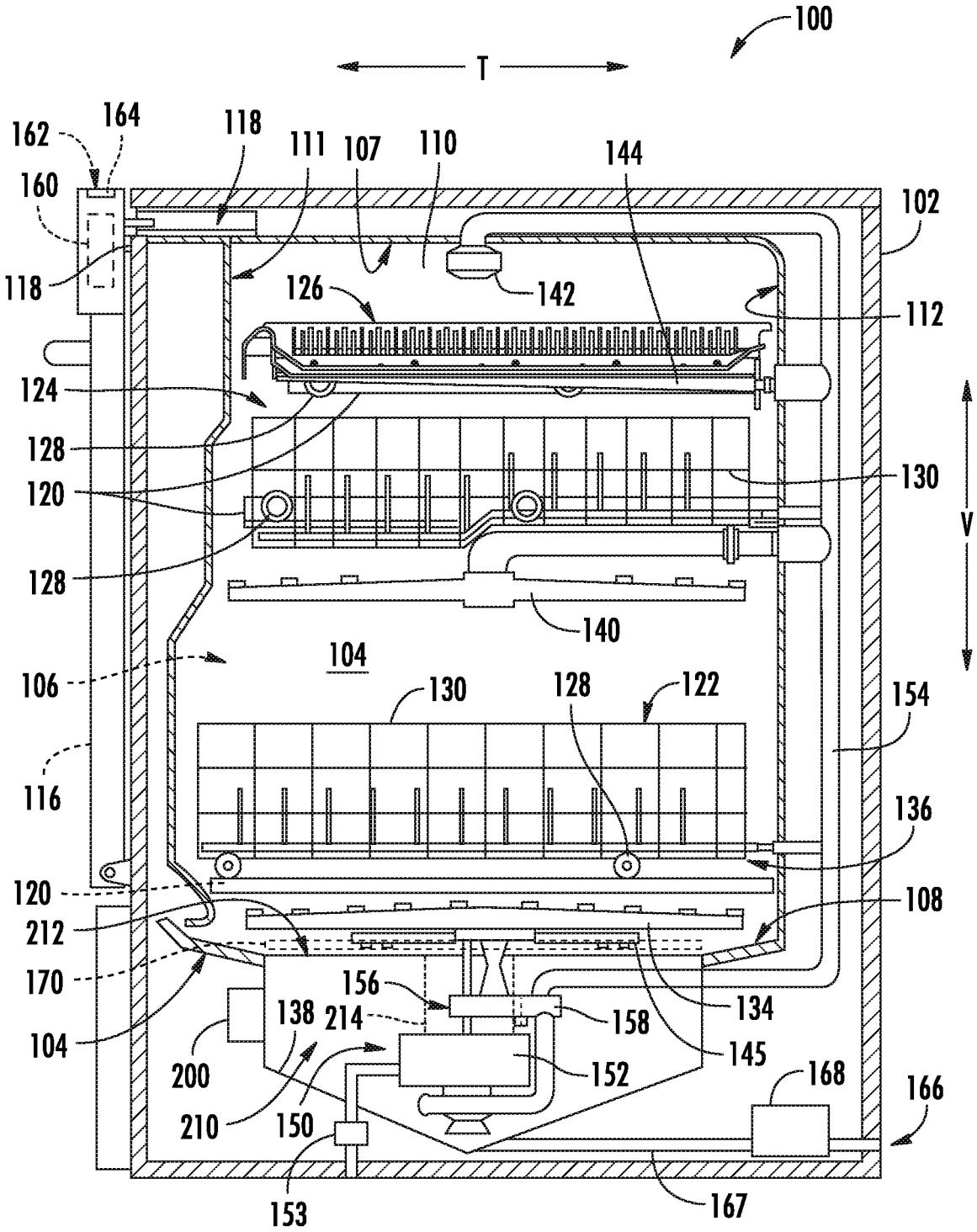
FIG. 2 provides a side, cross sectional view of the exemplary dishwashing appliance of FIG. 1.

Turning now to the figures, FIGS. 1 and 2 depict an exemplary dishwasher or dishwashing appliance (e.g., dishwashing appliance 100) that may be configured in accordance with aspects of the present disclosure. Generally, dishwasher 100 defines a vertical direction V, a lateral direction L, and a transverse direction T. Each of the vertical direction V, lateral direction L, and transverse direction T are mutually perpendicular to one another and form an orthogonal direction system.

Dishwasher 100 includes a cabinet 102 having a tub 104 therein that defines a wash chamber 106. As shown in FIG. 2, tub 104 extends between a top 107 and a bottom 108 along the vertical direction V, between a pair of side walls 110 along the lateral direction L, and between a front side 111 and a rear side 112 along the transverse direction T.

Tub 104 includes a front opening 114. In some embodiments, a door 116 hinged at its bottom for movement between a normally closed vertical position (e.g., FIG. 2), wherein the wash chamber 106 is sealed shut for washing operation, and a horizontal open position for loading and unloading of articles from dishwasher 100. A door 116 closure mechanism or assembly 118 may be provided to lock and unlock door 116 for accessing and sealing wash chamber 106. Optionally, closure assembly 118 may be configured to detect when door 116 is in the closed position (e.g., via a contact sensor, capacitive sensor, reed switch, etc.). Additionally or alternatively, closure assembly 118 may include one or more discrete sensors (e.g., accelerometer, gyroscope, etc.) mounted on or in selective engagement with door 116 to detect the position of door 116 (e.g., in an open position, closed position, or intermediate position between a horizontal open position and a closed position). In some embodiments, closure assembly 118 is configured to transmit a corresponding closed signal in response to door 116 being detected in the closed position.

In exemplary embodiments, tub side walls 110 accommodate a plurality of rack assemblies. For instance, guide rails 120 may be mounted to side walls 110 for supporting a lower rack assembly 122, a middle rack assembly 124, or an upper rack assembly 126. In some such embodiments, upper rack assembly 126 is positioned at a top portion of wash chamber 106 above middle rack assembly 124, which is positioned above lower rack assembly 122 along the vertical direction V.

Generally, each rack assembly 122, 124, 126 may be adapted for movement between an extended loading position (not shown) in which the rack is substantially positioned outside the wash chamber 106, and a retracted position (shown in FIGS. 1 and 2) in which the rack is located inside the wash chamber 106. In some embodiments, movement is facilitated, for instance, by rollers 128 mounted onto rack assemblies 122, 124, 126, respectively.

Although guide rails 120 and rollers 128 are illustrated herein as facilitating movement of the respective rack assemblies 122, 124, 126, it should be appreciated that any suitable sliding mechanism or member may be used according to alternative embodiments.

In optional embodiments, some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to additional or alternative embodiments, a silverware basket (not shown) is removably attached to a rack assembly (e.g., lower rack assembly 122), for placement of silverware, utensils, and the like, that are otherwise too small to be accommodated by the rack assembly.

Generally, dishwasher 100 includes one or more spray assemblies for urging a flow of fluid (e.g., wash fluid) onto the articles placed within wash chamber 106.

In exemplary embodiments, dishwasher 100 includes a lower spray arm assembly 134 disposed in a lower region 136 of wash chamber 106 and above a sump 138 so as to rotate in relatively close proximity to lower rack assembly 122.

In additional or alternative embodiments, a mid-level spray arm assembly 140 is located in an upper region of wash chamber 106 (e.g., below and in close proximity to middle rack assembly 124). In this regard, mid-level spray arm assembly 140 may generally be configured for urging a flow of wash fluid up through middle rack assembly 124 and upper rack assembly 126.

In further additional or alternative embodiments, an upper spray assembly 142 is located above upper rack assembly 126 along the vertical direction V. In this manner, upper spray assembly 142 may be generally configured for urging or cascading a flow of wash fluid downward over rack assemblies 122, 124, and 126.

In yet further additional or alternative embodiments, upper rack assembly 126 may further define an integral spray manifold 144. As illustrated, integral spray manifold 144 may be directed upward, and thus generally configured for urging a flow of wash fluid substantially upward along the vertical direction V through upper rack assembly 126.

In still further additional or alternative embodiments, a filter clean spray assembly 145 is disposed in a lower region 136 of wash chamber 106 (e.g., below lower spray arm assembly 134) and above a sump 138 so as to rotate in relatively close proximity to a filter assembly 210. For instance, filter clean spray assembly 145 may be directed downward to urge a flow of wash fluid across a portion of filter assembly 210 (e.g., first filter 212) or sump 138.

The various spray assemblies and manifolds described herein may be part of a fluid distribution system or fluid circulation assembly 150 for circulating wash fluid in tub 104. In certain embodiments, fluid circulation assembly 150 includes a circulation pump 152 for circulating wash fluid in tub 104. Circulation pump 152 may be located within sump 138 or within a machinery compartment located below sump 138 of tub 104.

When assembled, circulation pump 152 may be in fluid communication with an external water supply line (not shown) and sump 138. A water inlet valve 153 can be positioned between the external water supply line and circulation pump 152 (e.g., to selectively allow water to flow from the external water supply line to circulation pump 152). Additionally or alternatively, water inlet valve 153 can be positioned between the external water supply line and sump 138 (e.g., to selectively allow water to flow from the external water supply line to sump 138). During use, water inlet valve 153 may be selectively controlled to open to allow the flow of water into dishwasher 100 and may be selectively controlled to cease the flow of water into dishwasher 100. Further, fluid circulation assembly 150 may include one or more fluid conduits or circulation piping for directing wash fluid from circulation pump 152 to the various spray assemblies and manifolds. In exemplary embodiments, such as that shown in FIG. 2, a primary supply conduit 154 extends from circulation pump 152, along rear 112 of tub 104 along the vertical direction V to supply wash fluid throughout wash chamber 106.

In some embodiments, primary supply conduit 154 is used to supply wash fluid to one or more spray assemblies (e.g., to mid-level spray arm assembly 140 or upper spray assembly 142). It should be appreciated, however, that according to alternative embodiments, any other suitable plumbing configuration may be used to supply wash fluid throughout the various spray manifolds and assemblies described herein. For instance, according to another exemplary embodiment, primary supply conduit 154 could be used to provide wash fluid to mid-level spray arm assembly 140 and a dedicated secondary supply conduit (not shown) could be used to provide wash fluid to upper spray assembly 142. Other plumbing configurations may be used for providing wash fluid to the various spray devices and manifolds at any location within dishwashing appliance 100.

Each spray arm assembly 134, 140, 142, integral spray manifold 144, filter clean assembly 145, or other spray device may include an arrangement of discharge ports or orifices for directing wash fluid received from circulation pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray assemblies 134, 140, 142, 145 may be motor-driven, or may operate using any other suitable drive mechanism. Spray manifolds and assemblies may also be stationary. The resultant movement of the spray assemblies 134, 140, 142, 145 and the spray from fixed manifolds provides coverage of dishes and other dishwasher contents with a washing spray. Other configurations of spray assemblies may be used as well. For instance, dishwasher 100 may have additional spray assemblies for cleaning silverware, for scouring casserole dishes, for spraying pots and pans, for cleaning bottles, etc.

In optional embodiments, a filter assembly 210 is provided. As shown, in exemplary embodiments, filter assembly 210 is located in the sump 138 (e.g., to filter fluid to circulation assembly 150). Generally, filter assembly 210 removes soiled particles from the fluid that is recirculated through the wash chamber 106 during operation of dishwashing appliance 100. In certain embodiments, filter assembly 210 includes both a first filter 212 (also referred to as a "coarse filter") and a second filter 214 (also referred to as a "fine filter").

In some embodiments, the first filter 212 is constructed as a grate having openings for filtering fluid received from wash chamber 106. The sump 138 includes a recessed portion upstream of circulation pump 152 or a drain pump 168 and over which the first filter 212 is removably received. In exemplary embodiments, the first filter 212 operates as a coarse filter (e.g., having media openings in the range of about 0.030 inches to about 0.060 inches). The recessed portion may define a filtered volume wherein debris or particles have been filtered by the first filter 212 or the second filter 214.

In additional or alternative embodiments, the second filter 214 is provided upstream of circulation pump 152 or drain pump 168. Second filter 214 may be non-removable or, alternatively, may be provided as a removable cartridge positioned in a tub receptacle 216 (FIG. 3) formed in sump 138.

Figure 3:
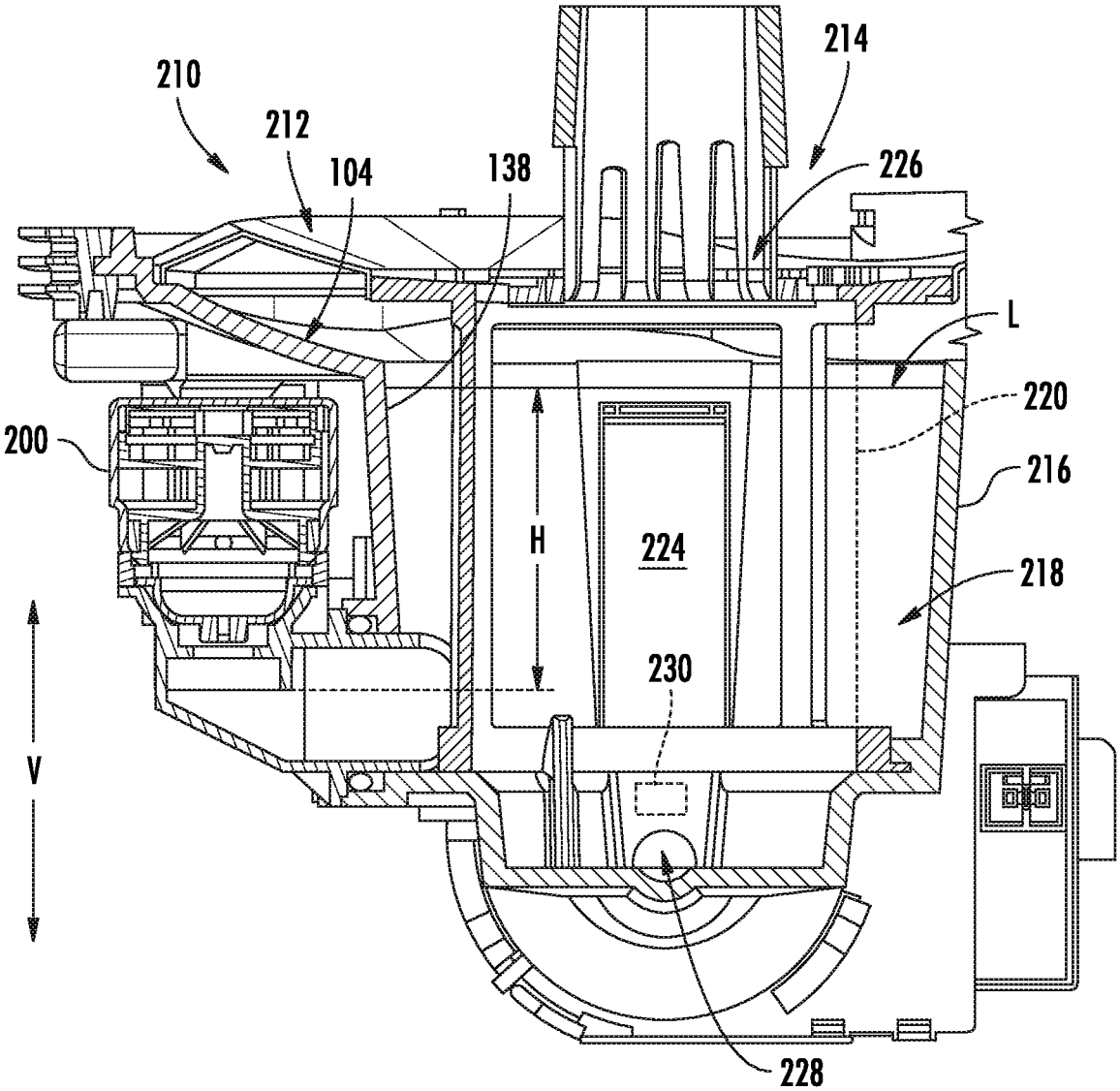
FIG. 3 provides a close up, cross sectional view of a sump and a pressure sensor of the dishwashing appliance of FIGS. 1 and 2.

For instance, turning especially to FIGS. 2 and 3, the second filter 214 may be removably positioned within a collection chamber 218 defined by tub receptacle 216. The second filter 214 may be generally shaped to complement the tub receptacle 216. For instance, the second filter 214 may include a filter wall 220 that complements the shape of the tub receptacle 216. In some embodiments, the filter wall 220 is formed from one or more fine filter media. Some such embodiments may include filter media (e.g., screen or mesh, having pore or hole sizes in the range of about 50 microns to about 600 microns).

When assembled, the filter wall 220 may have an enclosed (e.g., cylindrical) shape defining an internal chamber 224. In optional embodiments, a top portion of second filter 214 positioned above the internal chamber 224 may define one or more openings 226 (e.g., vertical flow path openings), thereby permitting fluid to flow into the internal chamber 224 without passing through the first filter 212 or the fine filter media of the filter wall 220 of the second filter 214.

Between the top portion openings 226 and drain pump 168, internal chamber 224 may define an unfiltered volume.

A drain outlet 228 may be defined below the top portion openings 226 in fluid communication with internal chamber 224 and drain pump 168 (e.g., downstream of internal chamber 224 or upstream of drain pump 168).

During, for example, a drain cycle, at least a portion of wash fluid within sump 138 may generally pass into internal chamber 224 through second filter 214 (e.g., through filter wall 220 or openings 226) before flowing through drain assembly 166 and from dishwashing appliance 100.

During operation of some embodiments (e.g., during or as part of a wash cycle or rinse cycle), circulation pump 152 draws wash fluid in from sump 138 through filter assembly 210 (e.g., through first filter 212 or second filter 214). Thus, circulation pump 152 may be downstream of filter assembly 210.

In optional embodiments, circulation pump 152 urges or pumps wash fluid (e.g., from filter assembly 210) to a diverter 156. In some such embodiments, diverter 156 is positioned within sump 138 of dishwashing appliance 100). Diverter 156 may include a diverter disk (not shown) disposed within a diverter chamber 158 for selectively distributing the wash fluid to the spray arm assemblies 134, 140, 142, or other spray manifolds. For instance, the diverter disk may have a plurality of apertures that are configured to align with one or more outlet ports (not shown) at the top of diverter chamber 158. In this manner, the diverter disk may be selectively rotated to provide wash fluid to the desired spray device.

In exemplary embodiments, diverter 156 is configured for selectively distributing the flow of wash fluid from circulation pump 152 to various fluid supply conduits—only some of which are illustrated in FIG. 2 for clarity. In certain embodiments, diverter 156 includes four outlet ports (not shown) for supplying wash fluid to a first conduit for rotating lower spray arm assembly 134, a second conduit for supplying wash fluid to filter clean assembly 145, a third conduit for spraying an auxiliary rack such as the silverware rack, and a fourth conduit for supply mid-level or upper spray assemblies 140, 142 (e.g., primary supply conduit 154).

Drainage of soiled wash fluid within sump 138 may occur, for instance, through drain assembly 166 (e.g., during or as part of a drain cycle). In particular, wash fluid may exit sump 138 through a drain outlet 228 and may flow through a drain conduit 167. In some embodiments, a drain pump 168 downstream of sump 138 facilitates drainage of the soiled wash fluid by urging or pumping the wash fluid to a drain line external to dishwasher 100. Drain pump 168 may be downstream of first filter 212 or second filter 214. Additionally or alternatively, an unfiltered flow path may be defined through sump 138 to drain conduit 167 such that an unfiltered fluid flow may pass through sump 138 to drain conduit 167 without first passing through filtration media of either first filter 212 or second filter 214.

Although a separate circulation pump 152 and drain pump 168 are described herein, it is understood that other suitable pump configurations (e.g., using only a single circulation pump for both circulation and draining) may be provided.

In certain embodiments, dishwasher 100 includes a controller 160 configured to regulate operation of dishwasher 100 (e.g., initiate one or more washing operations). Controller 160 may include one or more memory devices and one or more microprocessors, such as general or special purpose microprocessors operable to execute programming instructions or micro-control code associated with a washing operation that may include a wash cycle, rinse cycle, or drain cycle. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry—such as switches, amplifiers, integrators, comparators, flip-flops, AND gates, and the like—to perform control functionality instead of relying upon software).

Controller 160 may be positioned in a variety of locations throughout dishwasher 100. In optional embodiments, controller 160 is located within a control panel area 162 of door 116 (e.g., as shown in FIGS. 1 and 2). Input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of dishwasher 100. In some embodiments, user interface 164 includes a general purpose I/O ("GPIO") device or functional block. In additional or alternative embodiments, user interface 164 includes input components, such as one or more of a variety of electrical, mechanical or electromechanical input devices including rotary dials, push buttons, and touch pads. In further additional or alternative embodiments, user interface 164 includes a display component, such as a digital or analog display device designed to provide operational feedback to a user. When assembled, user interface 164 may be in operative communication with the controller 160 via one or more signal lines or shared communication busses. Additionally or alternatively, controller 160 may be in operative communication with various other portions of dishwashing appliance 100, such as circulation pump 152, drain pump 168, closure assembly 118, pressure sensor 200, etc. (e.g., to direct or regulate operation thereof during a washing operation).

In some embodiments, a heating element 170 is in operative communication (e.g., electrically coupled) to the controller 160 to selectively provide heat to the wash chamber 106 or wash fluid being circulated therethrough (e.g., during a wash cycle). For example, heating element 170 may be provided as a resistive or sheathed heating element 170 (e.g., CALROD®) mounted to a bottom portion of tub 104. In some such embodiments, heating element 170 is attached to a bottom wall 108 within the sump 138 or wash chamber 106. Nonetheless, heating element 170 may include or be provided any suitable heater for heating wash chamber 106 or wash fluid, as is generally understood. During use, the controller 160 may thus transmit one or more heating signals (e.g., as an electrical current) in order to activate heating element 170 and initiate the generation of heat therefrom.

It should be appreciated that the invention is not limited to any particular style, model, or configuration of dishwasher 100. The exemplary embodiment depicted in FIGS. 1 and 2 is for illustrative purposes only. For instance, different locations may be provided for user interface 164, different configurations may be provided for rack assemblies 122, 124, 126, different spray arm assemblies 134, 140, 142 and spray manifold configurations may be used, and other differences may be applied while remaining within the scope of the present disclosure.

Turning especially to FIG. 3, a close up, cross sectional view of sump 138 and a pressure sensor 200 is provided. In some instances, portions of dishwasher 100 may become obstructed or clogged (e.g., at filter assembly 210). In other instances, pressure within dishwasher 100 may change rapidly and temporarily without any obstruction (e.g., due to the door 116 (FIG. 1) being opened during a heated cycle). Accordingly, and in accordance with exemplary aspects of the present disclosure, dishwasher 100 uses outputs from pressure sensor 200 to accurately distinguish pressure variations caused by obstructions or some temporary factor (e.g., an expansion of rapidly heated air).

In some embodiments, pressure sensor 200 mounted to sump 138. For instance, pressure sensor 200 may be mounted upstream of internal chamber 224 and second filter 214. Additionally or alternatively, pressure sensor 200 may be mounted downstream of first filter 212.

Pressure sensor 200 is operatively configured to detect a liquid level within sump 138 and communicate the liquid level to controller 160 (FIG. 2) via one or more signals. Thus, pressure sensor 200 and controller 160 are generally provided in operative communication.

During use, pressure sensor 200 may transmit signals to controller 160 for instance, as a frequency, as an analog signal, or in another suitable manner or form that can be received by controller 160 to detect a pressure value (e.g., as a value of relative pressure or hydrostatic pressure, such as value in units of mm·$H_2O$). In certain embodiments, pressure sensor 200 is configured to sense the height H of the wash fluid above pressure sensor 200 along the vertical direction V (e.g., by detecting the pressure on pressure sensor 200).

In some embodiments, pressure sensor 200 includes a pressure plate that is generally acted on by the pressure of the wash fluid within sump 138. As the liquid level rises, the pressure plate is pushed upward along the vertical direction V and, thus, compresses air trapped within the housing and a diaphragm of pressure sensor 200. Compression may cause the diaphragm to flex or alter its position. As a result of the pressure and consequent movement of the diaphragm, a permanent magnet attached to the diaphragm may change its position in relation to a Hall-effect transducer. The transducer delivers one or more electrical signals proportional to the magnetic field of the magnet. Optionally, the signals from pressure sensor 200 may be linearized, digitized, or amplified before being sent to controller 160 for processing. Additionally or alternatively, the pressure sensor 200 may include a printed circuit board (PCB) board to electrically connect the various electrical components of pressure sensor 200. Moreover, pressure sensor 200 can be any suitable type of sensor capable of sensing the liquid level within dishwasher 100.

Notably, as an upstream sensor (e.g., upstream of circulation pump 152 or drain pump 168), signals from pressure sensor 200 may be used or configured for additional detections, such as detection of overfill or flood event (e.g., as would be caused by an out-of-level condition, an inlet water valve failure, or a drain pump 168 failure) that would otherwise go undetected by a pressure sensor 200 downstream (i.e., on the high-pressure side) of circulation pump 152 or drain pump 168.

In additional or alternative embodiments, a secondary fluid sensor 230 is provided in fluid communication between filter assembly 210 and drain outlet 228. In particular, secondary fluid sensor 230 may be downstream from second filter 214. For example, secondary fluid sensor 230 may be mounted within a portion of internal chamber 224 and configured to detect a fluid (e.g., wash fluid) level or fluid pressure within internal chamber 224. In some such embodiments, the detected fluid level detected at secondary fluid sensor 230 is independent of detected pressure at pressure sensor 200.

Generally, secondary fluid sensor 230 may be any suitable sensor configured to detect at least one predetermined fluid level within internal chamber 224. For instance, secondary fluid sensor 230 may include or be provided as a float switch, diaphragm pressure sensor 200, capacitive sensor, or optical sensor configured to detect fluid within internal chamber 224 (e.g., at the vertical position of secondary fluid sensor 230).

During use, secondary fluid sensor 230 may transmit signals to controller 160 for instance, as a frequency, as an analog signal, or in another suitable manner or form that can be received by controller 160. Thus, secondary fluid sensor 230 and controller 160 are generally provided in operative communication. From the signal or signal(s) received from secondary fluid sensor 230, controller 160 may be configured to determine if or how much (e.g., a height or volume of) fluid within internal chamber 224.

Figure 4:
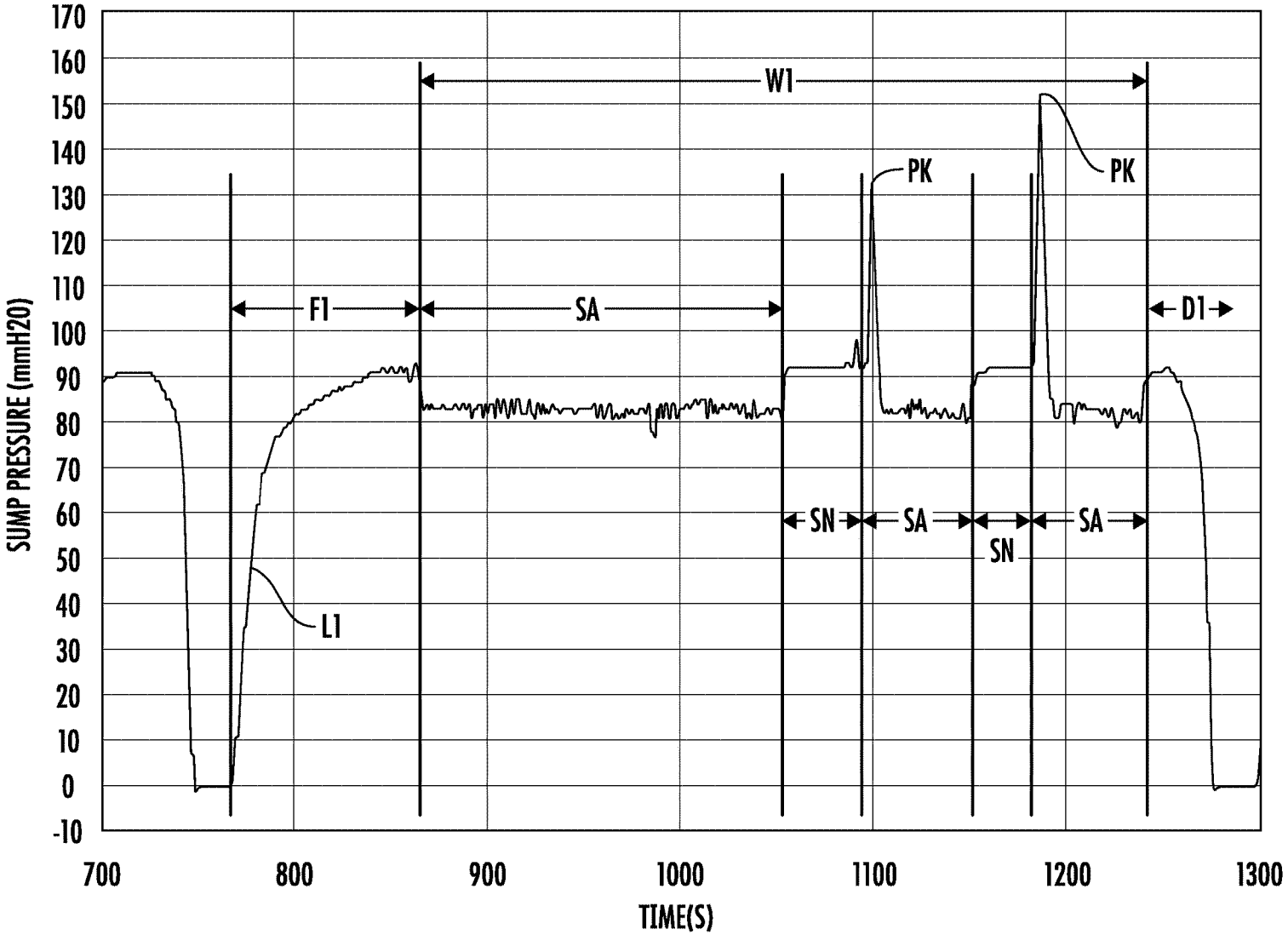
FIG. 4 provides a chart illustrating detected pressure over time during a dishwashing operation.

Turning briefly to FIG. 4, a chart is provided illustrating pressure values (e.g., detected at an upstream pressure sensor 200—FIG. 2) over a period of time. Specifically, FIG. 4 shows a line L1 illustrating variations in pressure that occur over the course of an exemplary execution of a washing operation that is interrupted at least twice by the opening of a door (e.g., 116). In the exemplary embodiment of FIG. 4, the washing operation includes a fill cycle F1, a wash cycle W1, and a drain cycle D1. The charted wash cycle W1 includes multiple active segments SA that are interrupted by two inactive segments SN (e.g., indicating the door 116 is not closed). Moreover, the filter 210 and circulation assembly 150 are generally free of any obstruction or clog. As would be understood, during the active segments SA of the wash cycle W1, various portions of dishwashing appliance 100 (FIG. 2) are activated. For instance, circulation pump 152 or heater 170 may be activated to circulate or heat water within wash chamber 106, as described above. By contrast, during the inactive segments SN, such portions may be inactive to halt water circulation or heating (e.g., as prompted by opening the door 116 or otherwise moving door 116 away from the closed position). Optionally pressure sensor 200 may continue to detect pressure within wash chamber 106 in both the active and inactive segments SA, SN (e.g., a predetermined polling or detection rate). Alternatively, pressure sensor 200 may detect pressure at the active segments SA while halting detection at the inactive segments SN.

Nonetheless, as illustrated, immediately following closing the door 116 and continuing the wash cycle W1, a pressure spike PK (e.g., rapid pressure increase or change) may occur. In other words, in the active segment SA immediately following an inactive segment SN, a pressure spike PK may be detected. The pressure spike PK represents a significant increase in wash chamber 106 pressure (e.g., caused by the rapid heating of cold air introduced when the door 116 was opened). Specifically, the pressure spike PK may represent a detected pressure value that is greater than a set pressure threshold (e.g., 100 mm·$H_2O$, although any suitable threshold value may be selected according to the particular embodiment). Although the pressure spike PK may be large, it is also temporary, lasting less than a predetermined baseline time period. Thus, pressure within the wash chamber 106 falls back below the pressure threshold for the remainder of the corresponding active segment SA (e.g., until a new cycle is initiated or until the door 116 is again moved from the closed position and a new inactive segment SN is initiated). Advantageously, an inaccurate indication of a flood event may be prevented.

Figure 5:
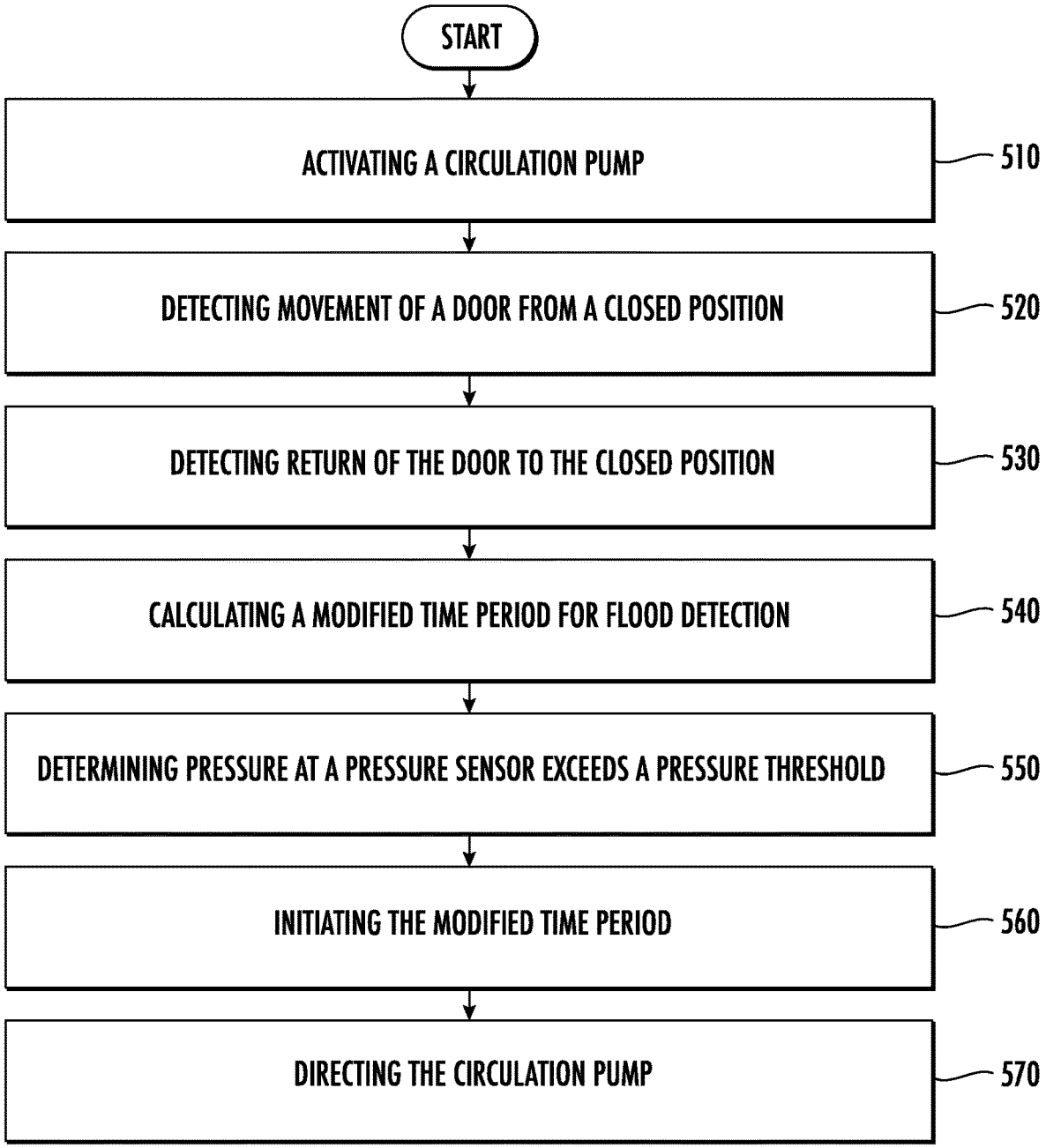
FIG. 5 provides a flow chart of a method of operating a dishwashing appliance, according to an exemplary embodiment of the present disclosure.
Figure 6:
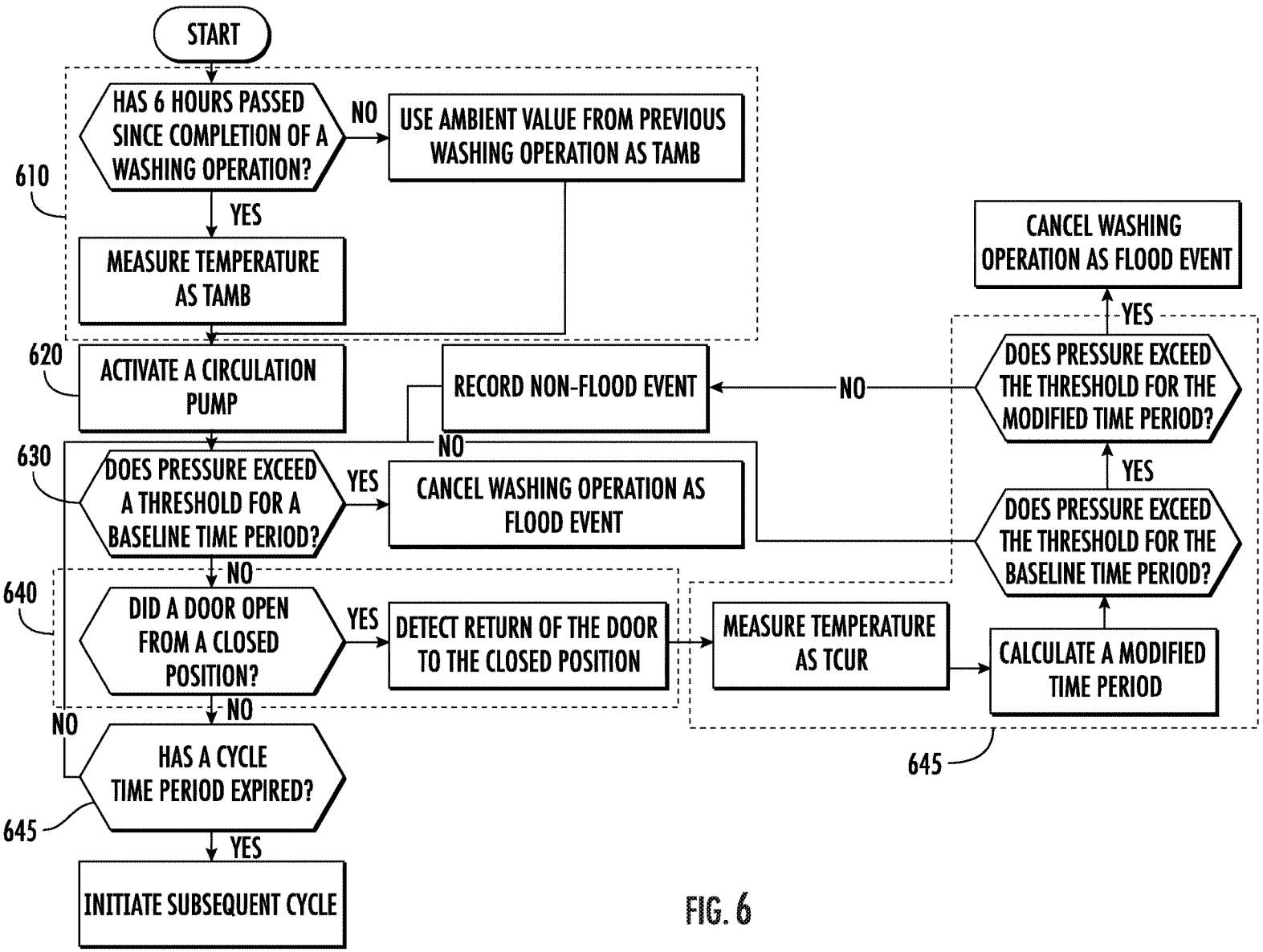
FIG. 6 provides a flow chart of a method of operating a dishwashing appliance, according to an exemplary embodiment of the present disclosure.

Turning now to FIGS. 5 and 6, various methods 500 or 600 for operating a dishwashing appliance are illustrated. Method 500 or 600 may be used to operate any suitable dishwashing appliance. As an example, some or all of method 500 or 600 may be used to operate dishwashing appliance 100 (FIG. 1). The controller 160 (FIG. 2) may be programmed to implement some or all of method 500 or 600 (e.g., as or as part of a washing operation, such as at a drain cycle).

It is noted that the order of steps within methods 500 and 600 are for illustrative purposes. Moreover, neither method 500 nor 600 is mutually exclusive. In other words, methods within the present disclosure may include either or both of methods 500 and 600. Both may be adopted or characterized as being fulfilled in a common operation. Except as otherwise indicated, one or more steps in the below method 500 and 600 may be changed, rearranged, performed in a different order, or otherwise modified without deviating from the scope of the present disclosure.

Turning especially to FIG. 5, at 510, the method 500 includes activating a circulation pump. For instance, 510 may occur following a fill cycle of the washing operation. For 510, the circulation pump may motivate or pump wash fluid from the wash chamber and through one or more spray assemblies that direct the wash fluid back to the wash chamber, as described above. The particular spray assembly or arm that circulation pump motivates wash fluid to may depend, for instance, on the particular washing operation (or settings thereof) selected by a user, as would be understood.

In optional embodiments, prior to 510, the method 500 includes establishing an ambient temperature (Tamb) for the washing operation. For instance, the ambient temperature may be established at the beginning of the washing operation, such as prior to a fill cycle. In some embodiments, the ambient temperature is established based on an old temperature value. The old temperature value may be stored within the dishwashing appliance from an operation predating the user's selection of the washing operation. For instance, if the dishwashing appliance determines a set rest period (e.g., 6 or more hours) since completion of a previous washing operation has not expired, the ambient temperature may be established as the same temperature value used in the previous operation. In certain embodiments, the ambient temperature is established based on a new temperature measurement. The new temperature measurement may be made at the temperature within the dishwashing appliance or wash chamber prior to the start of the washing operation. Optionally, the new temperature measurement may be collected in response to the dishwashing appliance determining the set rest period since completion of a previous washing operation has expired. Thus, although the new temperature measurement may be taken within the wash chamber, it may be assumed that the temperature within the wash chamber is roughly equivalent to the temperature outside of the dishwashing appliance.

During 510 (e.g., following the start of 510), the method 500 may include measuring pressure at the pressure sensor, as described above. Multiple discrete pressure measurements or values may be detected for the wash chamber at the same pressure sensor. For instance, pressure may be measured at a set schedule, rate, pattern, or interval during 510. Such pressure measurements may be evaluated or checked to determine if an elevated pressure (e.g., elevated detected pressure value) occurs during 510. In particular, if an elevated pressure (i.e., pressure above a pressure threshold) is detected, it may be determined if the elevated pressure is established for the duration of a baseline time period programmed within the dishwashing appliance. The baseline time period may start the moment elevated pressure is first detected and stop or restart once the pressure is detected below the pressure threshold. Thus, if the pressure is detected as being continuously above the pressure threshold for longer than baseline time period, the elevated pressure is established for the duration of a baseline time period. Elevated pressure continuing for the duration of the baseline time period may indicate a flood event prompting 500 to stop. By contrast, elevated pressure that ends prior to expiration of the baseline time period may permit the washing operation, generally, (or 510, specifically) to continue.

Additionally or alternatively, during 510, the heater may be activated to generate heat the wash chamber or otherwise heat wash fluid being circulated by the circulation pump. In particular, the heater may be activated for at least a portion of 510. Optionally, the heater may be activated in tandem (e.g., simultaneously) with the circulation pump (e.g., according to a set duty cycle). Optionally, the heater may be activated during only a portion of 510 such that 510 includes at least one heater-active segment and at least one heater-inactive segment.

At 520, the method 500 includes detecting movement of a door to the wash chamber from a closed position. In other words, the door being opened (e.g., fully or partially) from the closed position may be detected. The detection at 520 may be based on one or more received signals (e.g., from the door closure assembly). For instance, after receiving a closed signal from the door closure assembly during 510, transmission of the closed signal may be halted or a discrete opened signal may be received, or a separate position signal may be received corresponding to an open position, as would be understood.

In response to 520, the method 500 may halt the circulation pump. In other words, circulation of wash fluid motivated by the circulation pump may be abruptly stopped when the door is detected as being opened while 510 (or a wash cycle, generally) is ongoing, as would be understood. Additionally or alternatively, in response to 520, the heater may be halted such that the heater is no longer active to generate heat within wash chamber or heat wash fluid therein. Thus, heating of the wash chamber or wash fluid may be abruptly stopped when the door is detected as being opened while 510 (or a wash cycle, generally) is ongoing, as would further be understood.

Prior to 520, but subsequent to 510, the method 500 may include determining pressure at the pressure sensor exceeds a pressure threshold (e.g., predetermined pressure threshold). In other words, an elevated pressure may be detected by a comparison of a recently-detected pressure value to the pressure threshold. The determination may be made while the wash fluid continues to circulate. In response to determining the pressure exceeds the pressure threshold, a baseline time period (e.g., baseline countdown) may be initiated. It may, thus, be determined if the pressure remains elevated longer than the baseline time period.

The baseline time period may be a predetermined time period (e.g., programmed within the dishwashing appliance). Reduction of the pressure to or below the pressure threshold prior to the baseline time period expiring may indicate no flood event is taking place, and thus the method 500 (e.g., and circulation of the wash fluid) may be permitted to continue (e.g., to 530). Thus, the method 500 may include determining pressure at the pressure sensor reduces to or below the pressure threshold prior to expiration of the baseline time period. By contrast, maintenance of the pressure above the pressure threshold through expiration of the baseline time may indicate a flood event is occurring, and thus the method 500 and circulation of the wash fluid may be abruptly halted.

At 530, the method 500 includes detecting return of the door to the closed position. In other words, the door being closed following 520 may be detected. The detection at 530 may be based on one or more received signals (e.g., from the door closure assembly). For instance, after 520, a new or discrete closed signal from the door closure assembly may be received, or a separate position signal corresponding to the closed position may be received, as would be understood.

At 540, the method 500 includes calculating a modified time period (e.g., modified countdown) for flood detection. In some embodiments, the modified time period (PM) is greater than the baseline time period. Optionally, the modified time period may be a function of the baseline time period. Additionally or alternatively, the modified time period may be a function of a temperature difference.

As a general example, the modified time period may be based on a difference in the established ambient temperature (Tamb) and a current temperature (Tcur) within a flow path of the circulation pump (e.g., a temperature measurement collected at the temperature sensor within the wash chamber following 510 or 530). As a more specific example, PM may be calculated as $PM=\alpha\cdot(Tcur-Tamb)+\beta$, wherein $\alpha$ and $\beta$ are discrete predetermined coefficients. Optionally, $\alpha$ may be a coefficient value less than 1 (e.g., 0.09). Additionally or alternatively, $\beta$ may be a coefficient value greater than 1 (e.g., 2) or equal to the baseline time period (i.e., $\beta$ may be the baseline time period).

At 550, the method 500 includes determining pressure at a pressure sensor exceeds the pressure threshold (e.g., predetermined pressure threshold). In particular, following 530 or 540, a pressure measurement may be collected at the pressure sensor, as described above. Once collected, the pressure measurement may be compared to the pressure threshold and determined to be greater than the pressure.

At 560, the method 500 includes initiating the modified time period. Specifically, 560 may be initiated in response to 550. In other words, the modified time period or countdown thereof may be started immediately upon it being determined that the pressure exceeds the pressure threshold after the door is closed. It may, thus, be determined if the pressure remains elevated longer than the modified time period.

At 570, the method 500 includes directing the circulation pump based on measuring the elevated pressure at 550 and expiration of the modified time period from 560. As an example, such as when pressure remains elevated, 570 may include determining pressure at the pressure sensor continues to exceed the pressure threshold through expiration of the modified time period. In response to determining pressure continues to exceed the pressure threshold, 570 may further include halting the circulation pump or heater (e.g., abruptly) as a flood event. As another example, such as when pressure does not remain elevated, 570 may include determining pressure at the pressure sensor reduces to or below the pressure threshold prior to expiration of the modified time period. In response to determining pressure reduces, 570 may further include permitting continued activation of the circulation pump or heater as a non-flood event. Subsequently, the washing operation may be permitted to continue without interruption (e.g., until expiration of each cycle or total operation runtime for the washing operation).

Turning especially to FIG. 6, at 610, the method 600 includes establishing an ambient temperature (Tamb) for a washing operation. For instance, the ambient temperature may be established at or immediately following the beginning of the washing operation, such as prior to a fill cycle. Establishing Tamb may include determining if a set rest period (e.g., 6 or more hours) has elapsed or expired since completion of a previous washing operation. If the set rest period has not expired, the Tamb is established based on an old temperature value. The old temperature value may be stored within the dishwashing appliance from a previous washing operation (i.e., an operation predating the user's selection of the washing operation). Tamb may thus be established as the same temperature value used in the previous operation. If the set rest period has expired, Tamb is established based on a new temperature measurement. The new temperature measurement may be made at the temperature within the dishwashing appliance or wash chamber prior to the start of the washing operation, as described above.

At 620, the method 600 includes activating the circulation pump. For instance, 620 may occur following 610 or a fill cycle of the washing operation. For 620, the circulation pump may motivate wash fluid from the wash chamber and through one or more spray assemblies that direct the wash fluid back to the wash chamber, as described above. The particular spray assembly or arm that circulation pump motivates wash fluid to may depend, for instance, on the particular washing operation (or settings thereof) selected by a user, as would be understood.

During 620, the heater may be activated to generate heat the wash chamber or otherwise heat wash fluid being circulated by the circulation pump. In particular, the heater may be activated for at least a portion of 620. Optionally, the heater may be activated in tandem (e.g., simultaneously) with the circulation pump (e.g., according to a set duty cycle). Additionally or alternatively, the heater may be activated during only a portion of 620 such that 620 includes at least one heater-active segment and at least one heater-inactive segment.

At 630, the method 600 includes directing a baseline pressure evaluation. Specifically, pressure at the pressure sensor may be detected and it may be determined if the pressure exceeds a baseline pressure threshold.

The baseline time period may start the moment elevated pressure is first detected and stop or restart once the pressure is detected below the pressure threshold. Thus, if the pressure is detected as being continuously above the pressure threshold for longer than baseline time period, the elevated pressure is established for the duration of a baseline time period. Elevated pressure continuing for the duration of the baseline time period may indicate a flood event prompting 600 to stop (i.e., cancel washing operation). By contrast, elevated pressure that ends prior to expiration of the baseline time period may permit the continued activation of the circulation pump and continuation of the method 600 to 640.

At 640, the method 600 includes evaluating for an open-close event of the door. In other words, 640 includes monitoring for detection of first opening of the door from a closed position, and then the return of the door to the closed position.

Thus, the door being opened (e.g., fully or partially) from the closed position may be detected. The detection of the door being opened may be based on one or more received signals (e.g., from the door closure assembly). For instance, after receiving a closed signal from the door closure assembly following 620 or 630, transmission of the closed signal may be halted or a discrete opened signal may be received, or a separate position signal may be received corresponding to an open position, as would be understood. After the door being opened is detected, 640 includes detecting the door being closed. The detection of the door being closed may be based on one or more received signals (e.g., from the door closure assembly). For instance, the door is detected as being opened, a new or discrete closed signal from the door closure assembly may be received, or a separate position signal corresponding to the closed position may be received, as would be understood.

If the open-close event is detected (e.g., in response thereto), the method 600 may proceed to 645. If no opening or open-close event is detected, the method 600 may proceed (e.g., directly) to 650.

At 645, the method 600 includes directing a modified pressure evaluation. In particular, a current temperature (Tcur) within a flow path of the circulation pump may be collected or measured. For instance, Tcur may be measured at the temperature sensor within the wash chamber (e.g., at the same temperature sensor as used in 610).

Once the Tcur is measured or collected (e.g., in response thereto), a modified time period (PM) may be calculated. In some embodiments, PM is greater than the baseline time period. Optionally, the modified time period may be a function of the baseline time period. Additionally or alternatively, the modified time period may be a function of the difference between Tamb and Tcur. For instance, PM may be calculated as $PM=\alpha\cdot(Tcur-Tamb)+13$, wherein $\alpha$ and $\beta$ are discrete predetermined coefficients. Optionally, $\alpha$ may be a coefficient value less than 1 (e.g., 0.09). Additionally or alternatively, $\beta$ may be a coefficient value greater than 1 (e.g., 2) or equal to the baseline time period (i.e., $\beta$ may be the baseline time period).

After PM is calculated, 645 includes determining if pressure at the pressure sensor exceeds the pressure threshold for both the baseline time period and the modified time period. Both time periods may be initiated simultaneously or executed sequentially (e.g., depending on if PM is already calculated to include the baseline time period). If initiated sequentially, PM is initiated after expiration of the baseline time period. If pressure is reduced prior to expiration of either the baseline time period or the modified time period, the method 600 may return to 630 (i.e., permit the washing operation or activation of the circulation pump to continue). By contrast, if pressure remains above the pressure threshold for the duration of the baseline and modified time periods (i.e., through expiration of both time periods), a flood event may be indicated to prompt 600 to stop (i.e., cancel washing operation).

At 650, the method 600 includes evaluating operation runtime. If the cycle time period (e.g., initiated with the start of a corresponding wash cycle) has not yet expired, the method 600 may return to 630 (i.e., permit washing operation or activation of the circulation pump to continue). By contrast, if the cycle time period has expired, the method 600 may proceed to the subsequent cycle (e.g., drain cycle), as would be understood.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a dishwashing appliance comprising a tub, a pressure sensor mounted within the tub, a door selectively restricting access to the tub, and a circulation pump downstream from the pressure sensor, the method comprising:

activating the circulation pump;

determining pressure at the pressure sensor exceeds a pressure threshold following activating the circulation pump;

initiating a baseline time period in response to determining pressure at the pressure sensor exceeds the pressure threshold;

determining pressure at the pressure sensor reduces to or below the pressure threshold prior to expiration of the baseline time period;

detecting movement of the door from a closed position following determining pressure at the pressure sensor exceeds the pressure threshold;

detecting return of the door to the closed position;

calculating a modified time period for flood detection;

determining pressure at the pressure sensor exceeds the pressure threshold following detecting return of the door to the closed position;

initiating the modified time period in response to determining pressure at the pressure sensor exceeds the pressure threshold following detecting return of the door to the closed position; and directing the circulation pump based on determining pressure at the pressure sensor exceeds the pressure threshold following detecting return of the door to the closed position and expiration of the modified time period.

2. The method of claim 1, wherein directing the circulation pump comprises determining pressure at the pressure sensor continues to exceed the pressure threshold through expiration of the modified time period, and halting the circulation pump as a flood event in response to determining pressure at the pressure sensor continues to exceed the pressure threshold.

3. The method of claim 1, wherein directing the circulation pump comprises determining pressure at the pressure sensor reduces to or below the pressure threshold prior to expiration of the modified time period, and permitting continued activation of the circulation pump as a non-flood event in response to determining pressure at the pressure sensor reduces to or below the pressure threshold.

4. The method of claim 1, wherein the baseline time period is a predetermined time period and is less than the modified time period.

5. The method of claim 1, wherein the modified time period is a function of the baseline time period and a temperature difference.

6. The method of claim 1, wherein the modified time period is based on a difference in an ambient temperature value and a temperature value within a flow path of the circulation pump.

7. The method of claim 6, further comprising:

establishing the ambient temperature value based on an old temperature measurement of a previous washing operation.

8. The method of claim 6, wherein activating the circulation pump is based on a selected washing operation, and wherein the method further comprises:

establishing an ambient temperature value based on a temperature measurement of the selected washing operation prior to activating the circulation pump.

9. A dishwashing appliance, comprising:

a cabinet;

a tub positioned within the cabinet and defining a wash chamber for receipt of articles for washing;

a door mounted to the cabinet to selectively restrict access to the tub;

a spray assembly positioned within the wash chamber;

a circulation pump in fluid communication with the wash chamber;

a pressure sensor upstream of the circulation pump; and a controller in operative communication with the pressure sensor and the circulation pump, the controller being configured to initiate a washing operation, the washing operation comprising activating the circulation pump, determining pressure at the pressure sensor exceeds a pressure threshold following activating the circulation pump, initiating a baseline time period in response to determining pressure at the pressure sensor exceeds the pressure threshold, determining pressure at the pressure sensor reduces to or below the pressure threshold prior to expiration of the baseline time period, detecting movement of the door from a closed position following determining pressure at the pressure sensor exceeds the pressure threshold, detecting return of the door to the closed position, calculating a modified time period for flood detection, determining pressure at the pressure sensor exceeds the pressure threshold following detecting return of the door to the closed position, initiating the modified time period in response to determining pressure at the pressure sensor exceeds the pressure threshold following detecting return of the door to the closed position, and directing the circulation pump based on determining pressure at the pressure sensor exceeds the pressure threshold following detecting return of the door to the closed position and expiration of the modified time period.

10. The dishwashing appliance of claim 9, wherein directing the circulation pump comprises determining pressure at the pressure sensor continues to exceed the pressure threshold through expiration of the modified time period, and halting the circulation pump as a flood event in response to determining pressure at the pressure sensor continues to exceed the pressure threshold.

11. The dishwashing appliance of claim 9, wherein directing the circulation pump comprises determining pressure at the pressure sensor reduces to or below the pressure threshold prior to expiration of the modified time period, and permitting continued activation of the circulation pump as a non-flood event in response to determining pressure at the pressure sensor reduces to or below the pressure threshold.

12. The dishwashing appliance of claim 9, wherein the baseline time period is a predetermined time period and is less than the modified time period.

13. The dishwashing appliance of claim 9, wherein the modified time period is a function of the baseline time period and a temperature difference.

14. The dishwashing appliance of claim 9, wherein the modified time period is based on a difference in an ambient temperature value and a temperature value within a flow path of the circulation pump.

15. The dishwashing appliance of claim 14, wherein the washing operation further comprises establishing the ambient temperature value based on an old temperature measurement of a previous washing operation.

16. The dishwashing appliance of claim 9, wherein activating the circulation pump is based on a selected washing operation, and wherein the washing operation further comprises establishing an ambient temperature value based on a temperature measurement of the selected washing operation prior to activating the circulation pump.

17. A method of operating a dishwashing appliance comprising a tub, a pressure sensor mounted within the tub, a door selectively restricting access to the tub, and a circulation pump downstream from the pressure sensor, the method comprising:

activating the circulation pump;

detecting movement of the door from a closed position;

detecting return of the door to the closed position;

calculating a modified time period for flood detection;

determining pressure at the pressure sensor exceeds a pressure threshold following detecting return of the door to the closed position;

initiating the modified time period in response to determining pressure at the pressure sensor exceeds the pressure threshold; and directing the circulation pump based on determining pressure at the pressure sensor exceeds the pressure threshold and expiration of the modified time period, wherein the modified time period is calculated as a function of a temperature difference between an ambient temperature value and a temperature value within a flow path of the circulation pump.

18. The method of claim 17, wherein directing the circulation pump comprises determining pressure at the pressure sensor continues to exceed the pressure threshold through expiration of the modified time period, and halting the circulation pump as a flood event in response to determining pressure at the pressure sensor continues to exceed the pressure threshold.

19. The method of claim 17, wherein directing the circulation pump comprises determining pressure at the pressure sensor reduces to or below the pressure threshold prior to expiration of the modified time period, and permitting continued activation of the circulation pump as a non-flood event in response to determining pressure at the pressure sensor reduces to or below the pressure threshold.

20. The method of claim 17, wherein the baseline time period is a predetermined time period and is less than the modified time period.

* * * * *